US007350668B2

(12) United States Patent
Umeda

(10) Patent No.: US 7,350,668 B2
(45) Date of Patent: Apr. 1, 2008

(54) DISC DISPENSING APPARATUS

(75) Inventor: Masayoshi Umeda, Iwatsuki (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 209 days.

(21) Appl. No.: 11/142,527

(22) Filed: Jun. 1, 2005

(65) Prior Publication Data

US 2005/0279758 A1 Dec. 22, 2005

(30) Foreign Application Priority Data

Jun. 2, 2004 (JP) ..... 2004-164955

(51) Int. Cl.
*B65H 1/08* (2006.01)

(52) U.S. Cl. ..... 221/280; 221/172; 221/173; 221/267; 453/50; 453/32; 453/33; 453/11; 453/52

(58) Field of Classification Search ..... 221/267, 221/173, 172, 280; 453/50, 32, 33, 11, 52
See application file for complete search history.

(56) References Cited

U.S. PATENT DOCUMENTS 5,810,655 A * 9/1998 Suzukawa et al. ..... 453/50
6,059,651 A * 5/2000 Abe et al. ..... 453/50
6,866,574 B2 * 3/2005 Abe et al. ..... 453/52

* cited by examiner

*Primary Examiner*—Gene O. Crawford
*Assistant Examiner*—Timothy R Waggoner

(57) ABSTRACT

A disc dispensing apparatus operatively mounts to a disc passageway and includes a moveable guide hole member having a guide hole of an elongated shape and a guiding unit operatively mounted in the guide hole. A resilient unit biases the guiding unit against the movement of the discs and a moving unit is operatively attached to the moveable guide hole member for positioning the elongated guide hole at an angle to an axis of the disc passageway on one side of the disc passageway whereby a disc to be dispensed contacts the guiding unit and displaces the guiding unit along the elongated hole while receiving a counter force from the resilient unit to force the disc to be directed away from the guiding unit to one side of the disc passageway.

19 Claims, 9 Drawing Sheets

DISC DISPENSING APPARATUS

BACKGROUND OF THE INVENTION

1. Field of the Invention

The present invention relates to an improvement in a disc dispensing apparatus, which is used to dispense discs aligned in one row with peripheral edges of the discs kept in contact with each other, the discs being selectively dispensed to either the left or right of a guiding passageway. In particular, the invention relates to a modification of an apparatus, which is used for selectively dispensing discs delivered from a coin hopper to left and right of a guiding passageway.

2. Description of Related Art

As shown in FIG. 13 of U.S. Pat. No. 5,810,655, a conventional apparatus comprises a passageway for guiding discs delivered from a rotary selector disc of a coin hopper aligned in a line. A pair of guide grooves are provided on an extension of the passageway on the left and right of an axial line of the passageway in parallel with the axial line. A guide roller is movable while being guided in the guide grooves, and a moving unit for selectively moving the guide roller in left and right guide grooves is provided.

Therefore, when the guide roller is positioned in the left guide groove, a disc is discharged to the right side, and when the guide roller is positioned in the right guide groove, the disc is discharged to the left side.

When the position of the guide roller is changed over in this conventional type apparatus, the guide roller must be separated from the disc.

When the guide roller is in contact with the disc, the guide roller requires a relatively high force to climb over an arcuate peripheral surface of the disc at a steep angle. To obtain sufficient force to automatically move the guide roller, a solenoid with large capacity may be used, for instance. However, this necessitates the designing of the apparatus in a larger size, and this also results in higher cost. Also, for the purpose of preventing the contact of the guide roller with the disc during the changeover process, it is not possible to freely set the length of the passageway. Also, the length of the passageway must be changed every time the diameter of the disc is changed. This means that a more troublesome working procedure is required.

Further, in case the disc dispensing apparatus is used in a game machine, a predetermined number of discs are continuously discharged. The number of the discs discharged often exceeds one million pieces. For this reason, due to the repeated hitting of the pivot axis against the end of the guide groove, the groove suffers a condition of fatigue. It can be protruded in a lateral direction and can hinder smooth movement of the guide roller, and the discs may be not adequately discharged.

SUMMARY OF THE INVENTION

It is a first object of the present invention to provide a disc dispensing apparatus, by which it is possible to freely set a length of a passageway.

It is a second object of the present invention to provide a disc dispensing apparatus, by which it is possible to change over the position of the guiding unit by a relatively weak force.

It is a third object of the present invention to provide a disc dispensing apparatus of a compact size and at a low cost.

It is a fourth object of the present invention to reduce a resilient force applied on the guiding unit as much as possible.

To attain the above objects, the present invention provides a disc dispensing apparatus, which comprises a guiding passageway for guiding discs aligned in one line, a guide hole pivotally movable around an axis with an axial line almost perpendicularly crossing the guiding passageway near an outlet of the guiding passageway on an extension of the guiding passageway, guiding unit guided to the guide hole and resiliently pushed toward the guiding passageway, and a moving unit for selectively moving the guide hole in pivotal movement.

In the arrangement as described above, the guide hole is pivotally moved around an axis positioned near an outlet of the guiding passageway, and its position is selectively changed over to left or right of the guiding passageway. The guiding unit is guided through the guiding passageway thus changed over and can be moved in a direction separated and away from the guiding passageway. Therefore, the discs driven along the guiding passageway push and move the guiding unit against its resilient force. Immediately after the diameter portion of the disc passes between the demarcated portion of the guiding passageway and the guiding unit, discs are discharged by resilient force of the guiding unit.

When the guiding unit is moved while keeping contact with the disc, the guiding unit is moved together with the guiding passageway in a pivotal movement. In other words, the guiding unit is pivotally moved with its center near the outlet of the guiding passageway.

On the other hand, the discs positioned in the guiding passageway are placed in such positions that a portion from the center of each disc to a peripheral edge is protruded from the guiding passageway. That is, the radius of curvature of arcuate moving route of the guiding unit is approximately equal to the radius of curvature of arcuate outer edge of the disc. Therefore, when the guiding unit moves while keeping contact with the disc, the guiding unit can climb over the top of the disc only by a weak force. As a result, the guiding unit can move while keeping contact with the disc, and there is no limitation to the length of the guiding passageway.

Also, even when the guiding unit is in contact with the disc, the guiding unit can be moved by a weak force. As a result, it is possible to use a small-size actuator. This is advantageous in that the apparatus can be designed in a more compact size and can be produced at lower cost.

Further, when the guiding unit is moved by discs, the guiding unit is moved along the guide hole. The guide hole is moved in pivotal movement around a fulcrum near the outlet of the guiding passageway, and it is tilted with respect to the disc passageway. When the guiding unit is moved by the discs, the moving distance is reduced due to this tilting. Therefore, variation in the resilient force applied to the guiding unit is low, and this is advantageous in that the speed of discharge can be kept at constant level.

In the present invention, it is preferable that the axis of the pivotal movement is positioned approximately at the middle point between the largest width and the smallest width of the guiding passageway. In this arrangement, width of the guiding passageway is adjusted to suit the diameter of the disc.

The fulcrum of pivotal movement is positioned at the middle point of the largest coin and the smallest coin that will be dispensed. As a result, when there is a change in disc diameter, the change at the outlet of the guiding passageway and the moving distance of the guiding unit are at the smallest. This is helpful to ensure uniform discharge of the discs.

In the present invention, it is preferable that the guiding unit is a roller, which is rotatable around the pivot axis. In this arrangement, the discs come into contact with the roller when the discs are guided by the guiding unit and are discharged. The roller is brought into rolling contact with peripheral surface of the disc and also in rolling contact with the pivot axis. As a result, moving resistance is low. This ensures smooth discharge of the discs.

In the present invention, it is preferable that an end rather than the mounting portion of the guiding unit of the lever acts as an operating piece of a position sensor.

In this arrangement, when the position sensor is arranged in a dead space surrounded by the other components, the position sensor can be installed without requiring a design of the apparatus in a larger size.

In the present invention, it is preferable that the guiding passageway comprises a base plate, a pair of guide plates arranged in parallel by keeping a gap from the base plate, and a holding plate positioned on the side of the guide plate opposite to the base plate. In this arrangement, it is possible to provide an outlet for discs between an upper end of the guide plate and the guiding unit. This facilitates a simple arrangement for the outlet. As a result, the apparatus can be provided at a low cost. Also, by adequately changing the thickness of the guide plates and/or the distance between them, it is possible to cope with discs of different sizes.

In the present invention, it is preferable that the guiding unit comprises a roller rotatable around the pivot axis, and a resilient device exerting action on both ends of the shaft.

In this arrangement, frictional resistance to the movement of discs is low, and this ensures smooth discharge of the discs. Also, an approximately uniform bias force is applied on the pivot axis because the resilient device exerts a force on both ends of the pivot axis. As a result, the pivot axis is moved almost in parallel, and the guiding unit is moved smoothly. This also ensures a smooth discharge of the discs.

In the present invention, it is preferable that the apparatus comprises a base plate, a pair of guide plates arranged in parallel with a gap from the base plate, a guiding passageway containing a holding plate positioned on the side of the guide plate opposite to the base plate, said apparatus further comprising a lever pivotally supported on a fulcrum near the outlet of the guiding passageway and on one side of the central line of the guiding passageway, a guide hole formed on the lever, a roller rotatable around a pivot axis slidable in the guide hole, and a spring engaged on both ends of the pivot axis.

In this arrangement, discs are guided to the guiding passageway and reach the position of the roller, which acts as the guiding unit. The discs further continue to advance while moving the roller away from the guiding passageway. When the portion with the largest diameter of the disc passes between the roller and the guide plate, the disc is vigorously driven out by the roller pushed by the spring, and the disc is discharged through the outlet. When the roller is moved by a pivotal movement of the lever around a fulcrum near the outlet of the guiding passageway, the roller is moved by drawing an arc around the fulcrum. On the other hand, outer periphery of the disc positioned at the outlet is in an arcuate shape, and the arcuate portions have arcs each having almost the same radius of curvature.

In this respect, when the roller is moved while keeping contact with an outer peripheral surface of the disc, the roller is rolled with respect to the disc. Further, because the radius of curvature of the outer peripheral surface of the disc is approximately the same as the radius of curvature of the moving arc of the roller, the moving resistance is not high, and it can be moved with a relatively weak force. Then, the disc is brought into contact with the roller and is vigorously discharged through the outlet between the roller pushed by the spring and the other guide plate.

This arrangement ensures a smooth discharge of the discs. Because there is only one guiding passageway, and the apparatus has lower thickness and can be designed in a compact size, further, the discs are vigorously discharged by the roller, and the discs are not jammed together. Also, duplicated counting of a single disc can be prevented. Further, this is a simple arrangement, and the cost is reduced.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

In the explanation as given below, the terms "above", "below", "left" and "right" are used only to facilitate the explanation. Therefore, for the purpose of understanding the scope of the patent right of the present invention, the expression of the terms "above", "below", "left" and "right" are not limited to the above terms.

The "disc" used in the present specification includes a coin used as currency, a substitute for coin such as medals, tokens, etc. for use in a game machine, and other objects similar to these. The disc may be designed in any shape such as pentagonal, hexagonal, octagonal shape or in a shape similar to a disc.

Figure 1:
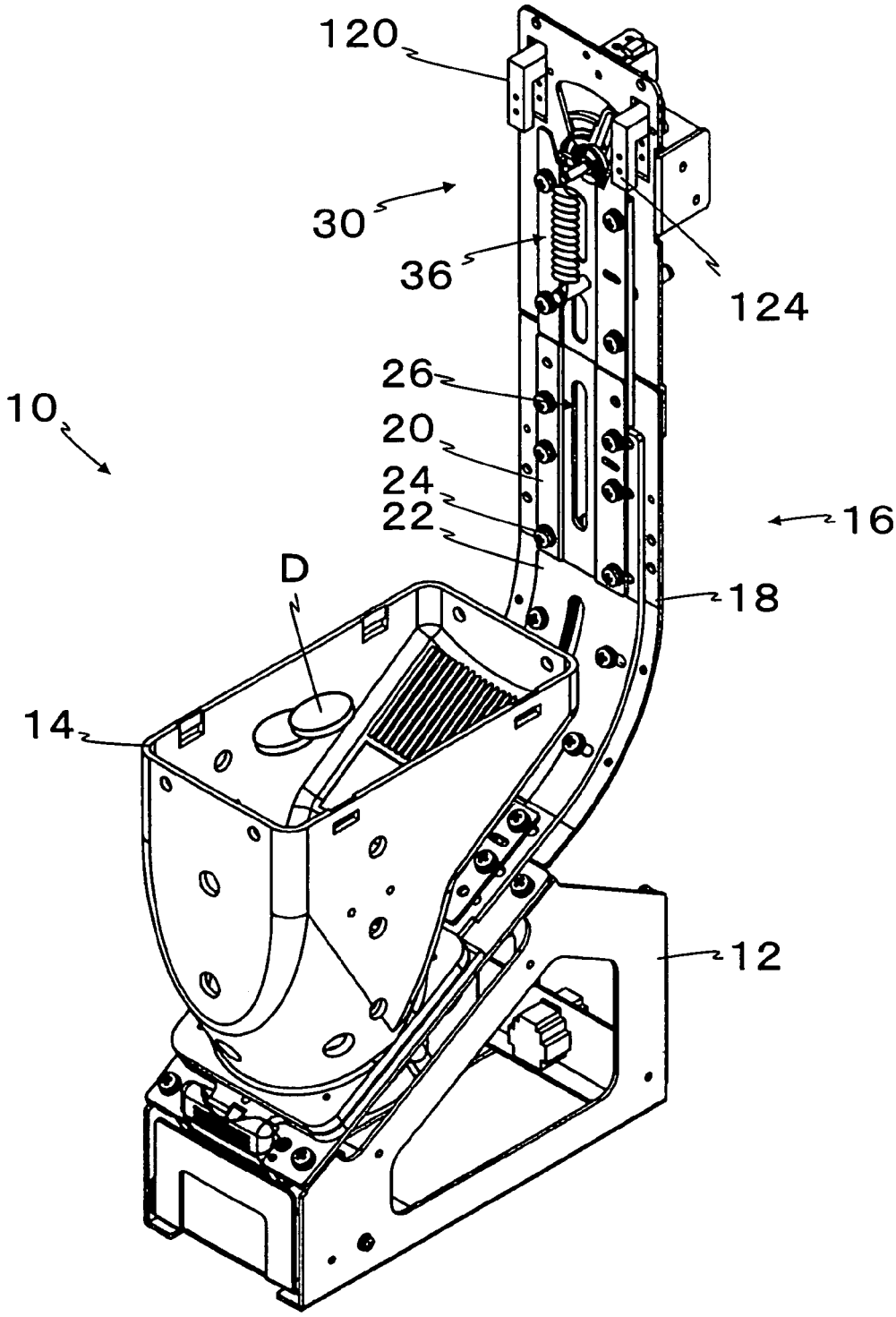
FIG. 1 is a general perspective view of a coin hopper provided with a dispensing apparatus of an embodiment of the present invention.

In FIG. 1, a coin hopper 10 comprises a frame 12, a holding bowl 14 designed in a tube-like shape for holding discs D, and a rotary disc (not shown) to deliver the discs D to be rotated at a bottom portion of the holding bowl 14. The coin hopper 10 is, for example, of the type disclosed in Japanese laid open Application No. 6-150102.

An escalator 16 extending upward is fixed on the frame 12. The escalator 16 comprises a base 18 in a longitudinal rectangular shape, a pair of guide plates (not shown) each in the shape of an elongated plate with a thickness slightly thicker than that of the disc D, and support plates 20 and 22 to be engaged with the guide plates. A distance between the pair of guide plates is slightly longer than a diameter of the disc D.

At the center of each of the support plates 20 and 22, a protruding ridge is formed in a longitudinal direction and is located between said guide plates. A distance between the protruding ridges of the support plates 20 and 22 and the base 18 is slightly thicker than the thickness of the disc D. In other words, it is such a thickness that two discs cannot be overlaid in it. By putting screws 24 into the base 18 to penetrate the support plates 20 and 22 and the guide plates, these components are integrated with each other.

An escalator guiding passageway 26 is extending in vertical direction and has a cross-sectional rectangle configuration, which is enclosed by the base 18, the guide plates and the support plates 20 and 22.

Figure 2:
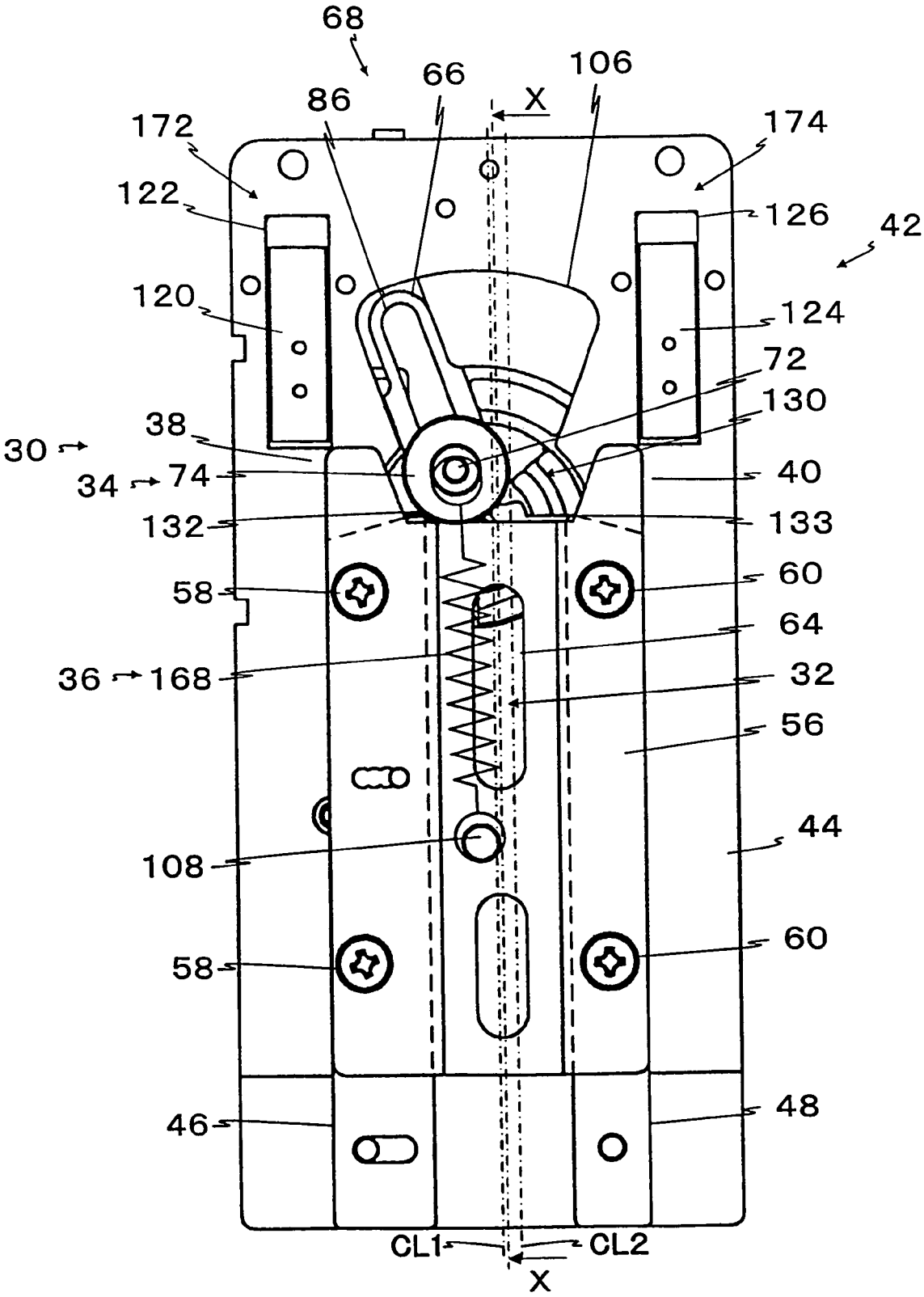
FIG. 2 is a front view of a dispensing apparatus of the present embodiment.

A dispensing apparatus 30 is mounted on an upper end of the escalator 16. As shown in FIG. 2, the dispensing apparatus 30 comprises a guiding passageway 32, guiding unit 34, a resilient device 36, a first outlet 38, a second outlet 40, and a disc detecting device 42.

First, a description will be given on the guiding passageway 32.

Figure 3:
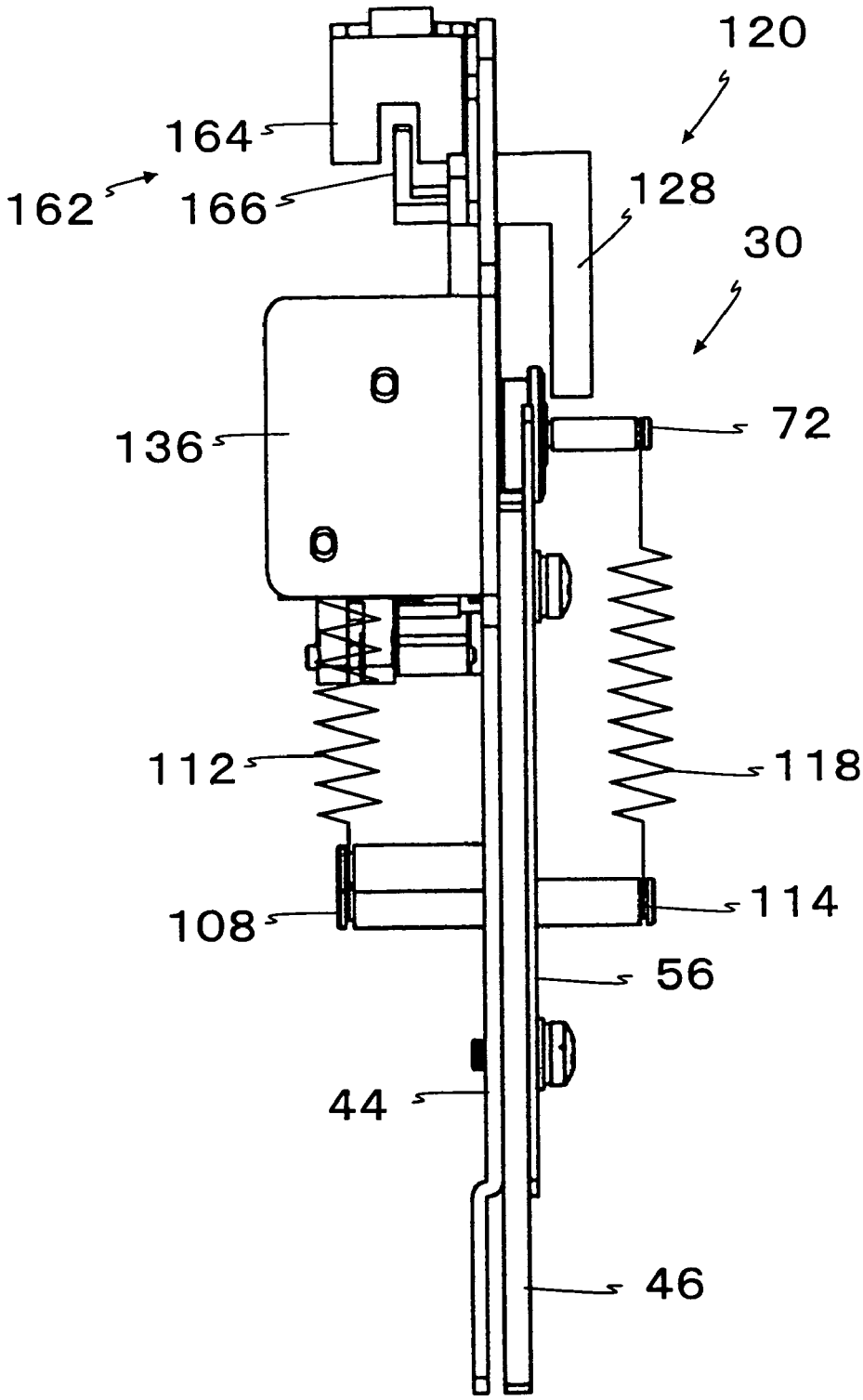
FIG. 3 is a side view as seen from the right of the dispensing apparatus of the present embodiment.
Figure 4:
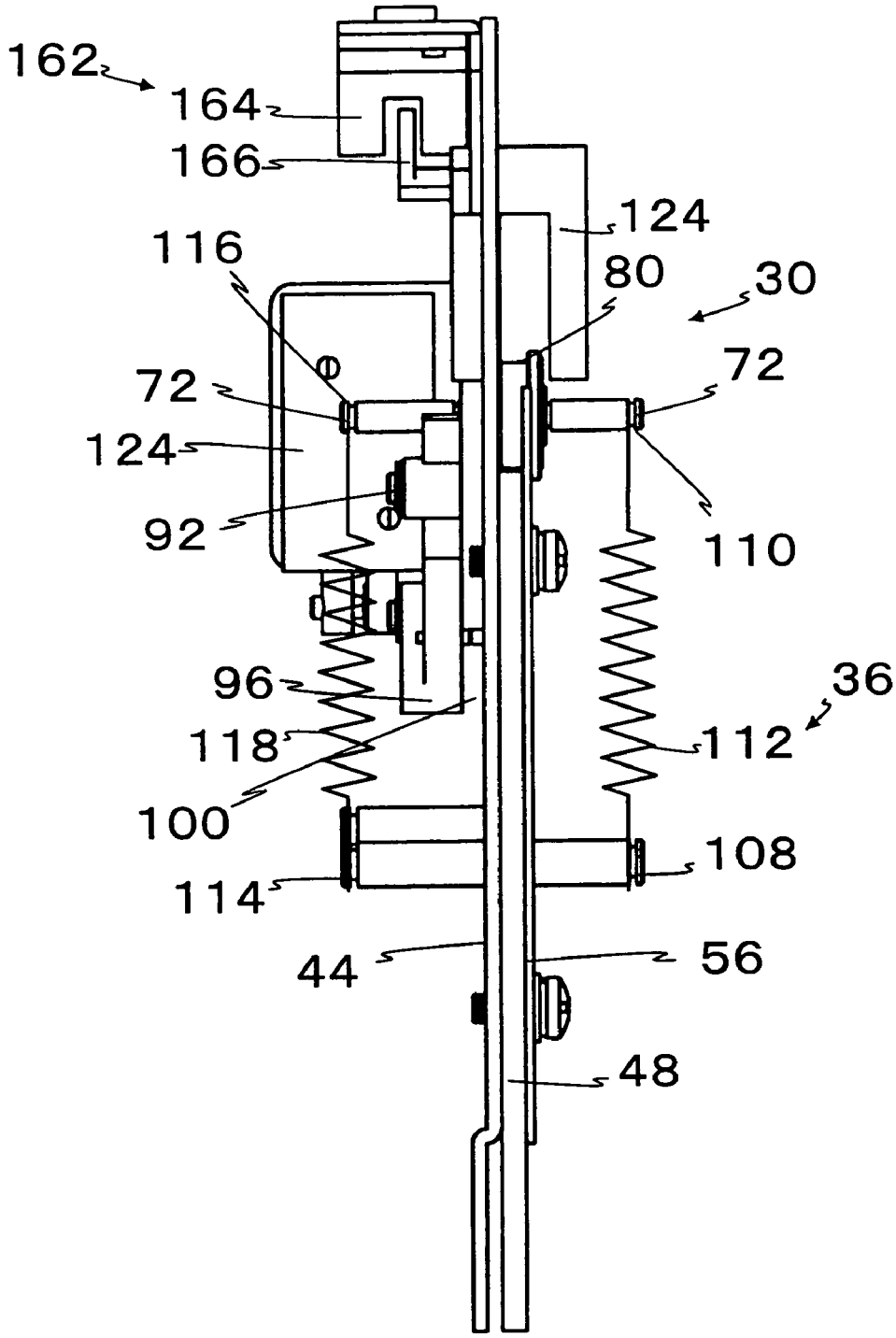
FIG. 4 is a side view as seen from the left of the dispensing apparatus of the present embodiment.

As shown in FIG. 3 and FIG. 4, a base plate 44 in a rectangular shape with its lower end designed in a crank-like form is arranged in an approximately vertical position. On a front side (right side in FIG. 3) of the base plate 44, a first guide plate 46 and a second guide plate 48 extend in vertical direction, and these items are arranged in parallel to each other with a predetermined spacing (see FIG. 2 and FIG. 7). The first guide plate 46 and the second guide plate 48 constitute the guide plates.

Each of the first guide plate 46 and the second guide plate 48 is designed in a longitudinal rectangular shape. On the upper end surface of each of the guide plates, a first inclined surface 52 and a second inclined surface 54 are each inclined downward toward an outside position are formed respectively. A distance between the first guide plate 46 and the second guide plate 48 is slightly longer than a diameter of the disc D. When the size of the disc D is changed, the second guide plate 48 can be moved in parallel in a right-ward direction in FIG. 7. As a result, the distance between the first guide plate 46 and the second guide plate 48 is changed to a distance slightly longer than the diameter of the disc D.

A plurality of screws 58 penetrating a rectangular holding plate 56 and the first guide plate 46 are screwed into the base plate 44, and these are integrated together. Screws 60 penetrate the holding plate 56 and the second guide plate 48 and are screwed into the base plate 44.

Therefore, the base plate 44, the first guide plate 46, the second guide plate 48 and the holding plate 56 make up a guiding passageway 32, which has a rectangular cross-section and is extending in a vertical direction. The width of the guiding passageway 32 is slightly longer than the diameter of the disc D, and its thickness is slightly thicker than the thickness of the disc D. A hole extending in a vertical direction at the center of the holding plate 56 is a peep hole 64 to observe the guiding passageway 32 for maintenance purposes.

When the dispensing apparatus 30 is fixed at a tip of the escalator 16, the first guide plate 46 and the second guide plate 48 are positioned on an extension of the guide plate (not shown) of the escalator 16. Therefore, the guiding passageway 32 is positioned on an extension of the escalator guiding passageway 26. As a result, the disc D is pushed up from the escalator guiding passageway 26 toward the guiding passageway 32. The dispensing apparatus 30 comprises guiding unit 34, a guiding device 68 of the guiding unit 34, and a moving unit 70 of the guiding device 68. The dispensing apparatus 30 has the functions to selectively change over a direction to deliver the disc D to either right or left of the guiding passageway 32, i.e. toward the first outlet 38 or to the second outlet 40. It also has a function to limit the movement of the moving disc D and to drive out the disc with a relatively weak force.

The guiding unit 34 preferably comprises a roller 74, which is rotatably mounted on a pivot axis 72. The guiding unit 34 may be substituted with a fixed pin, but it is preferable to use the roller 74 for the purpose of reducing frictional resistance to the disc D. The roller 74 is made of integrally molded resin, which has high abrasion resistance. As a resin, it is desirable to use a polyacetal resin, which has high shock resistance and high abrasion resistance although other material can be used.

Figure 6:
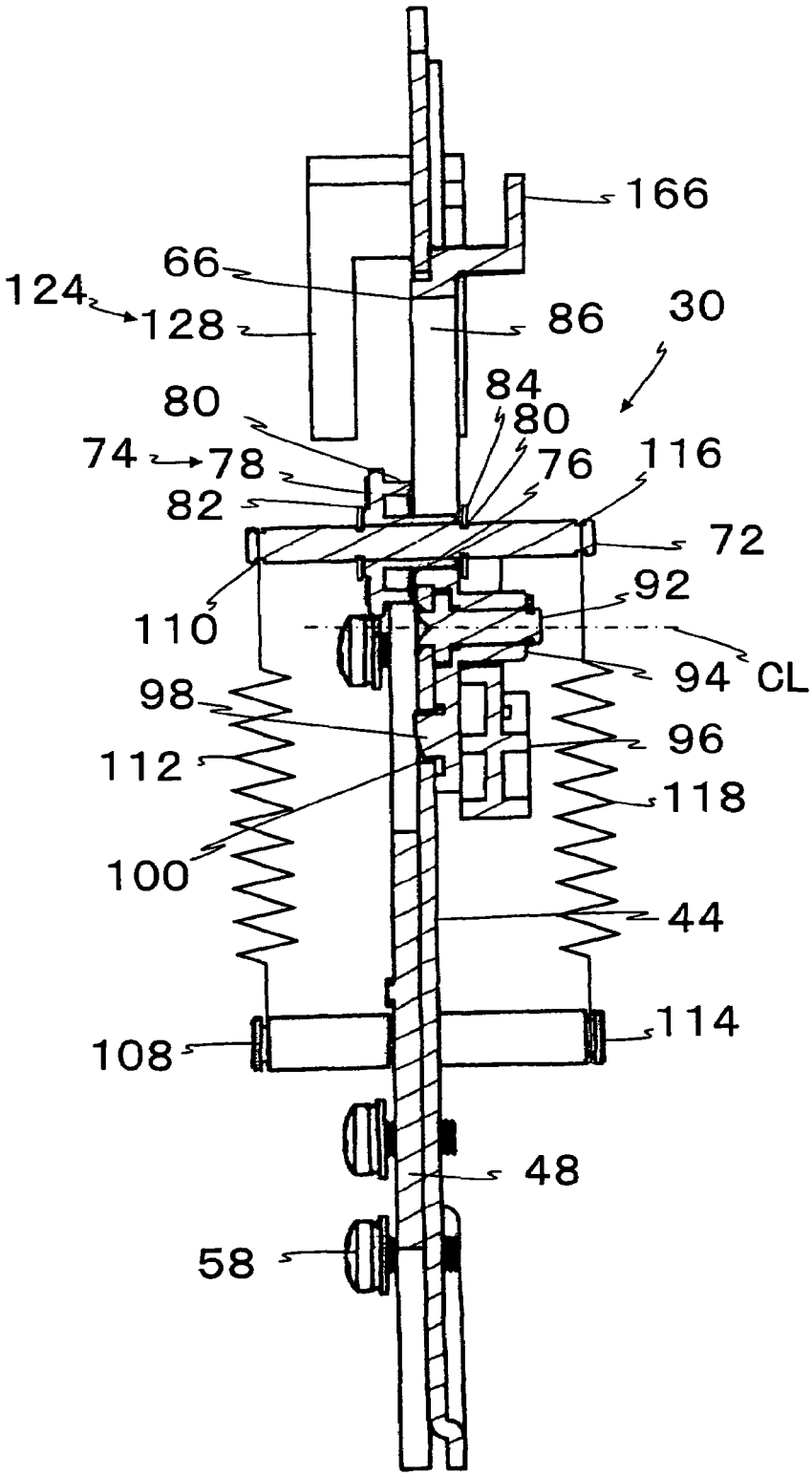
FIG. 6 is a cross-sectional view along the line X-X in FIG. 2 when guiding unit of the dispensing apparatus of the present embodiment is positioned at the center of a guiding passageway.

As shown in FIG. 6, the roller 74 comprises a bearing 76 in cylindrical shape, a bottom portion 73 in a disc-like shape and protruding in a peripheral direction from an end of the bearing 76, and a contact portion 80 protruding in cylindrical shape so that the bearing 76 is enclosed from the middle of the bottom portion 78.

The bearing 76 is engaged with the pivot axis 72, and its position is determined by snap rings 82 and 84, each of which locks a right end and a left end of the bearing on the pivot axis 72 respectively, and the bearing can be rotated with respect to the pivot axis 72 at a predetermined position.

It is preferable to arrange a low friction member (not shown) in a ring-like shape between the snap ring 82 and the bottom portion 78. This is further to ensure smooth rotation of the roller 74.

Next, a description will be given of the guiding device 68 by referring to FIG. 2 and FIG. 6. The guiding device 68 has a function to guide the guiding unit 34 with the roller 74 assembled on the pivot axis 72 so that the guiding unit 34 can be moved with respect to the guiding passageway 32. A lever 66 is pivotably mounted on a pivot axis 92, which is arranged near an outlet 90 of the guiding passageway 32.

The pivot axis 92 has its base caulked on the base plate 44 so that its axial line CL perpendicularly crosses the base plate 44—in other words, the axial line CL crosses perpendicularly the guiding passageway 32. The pivot axis 92 may be positioned on an extension of the guiding passageway 32 if it is near the outlet 90. The lever 66 is extending along an axial line PL passing through the pivot axis 92 from the base 96, which has a bearing 94 rotatably mounted on the pivot axis 92. On the lever 66, a guide hole 86 of an elongated linear shape is formed along the axial line PL.

The bearing 94 has a length more than twice as long as the diameter of the pivot axis 92 so that the lever 66 can be pivotally moved while maintaining a right angle to the pivot axis 92. By the guiding unit 34, the bearing 76 is passed through the guide hole 86. By applying an end surface of the contact portion 80 on the lever 66 and by applying the snap ring 84 on a rear surface of the lever 66, the guiding unit 34 can be moved in parallel while it is guided in the guide hole 86.

Figure 7:
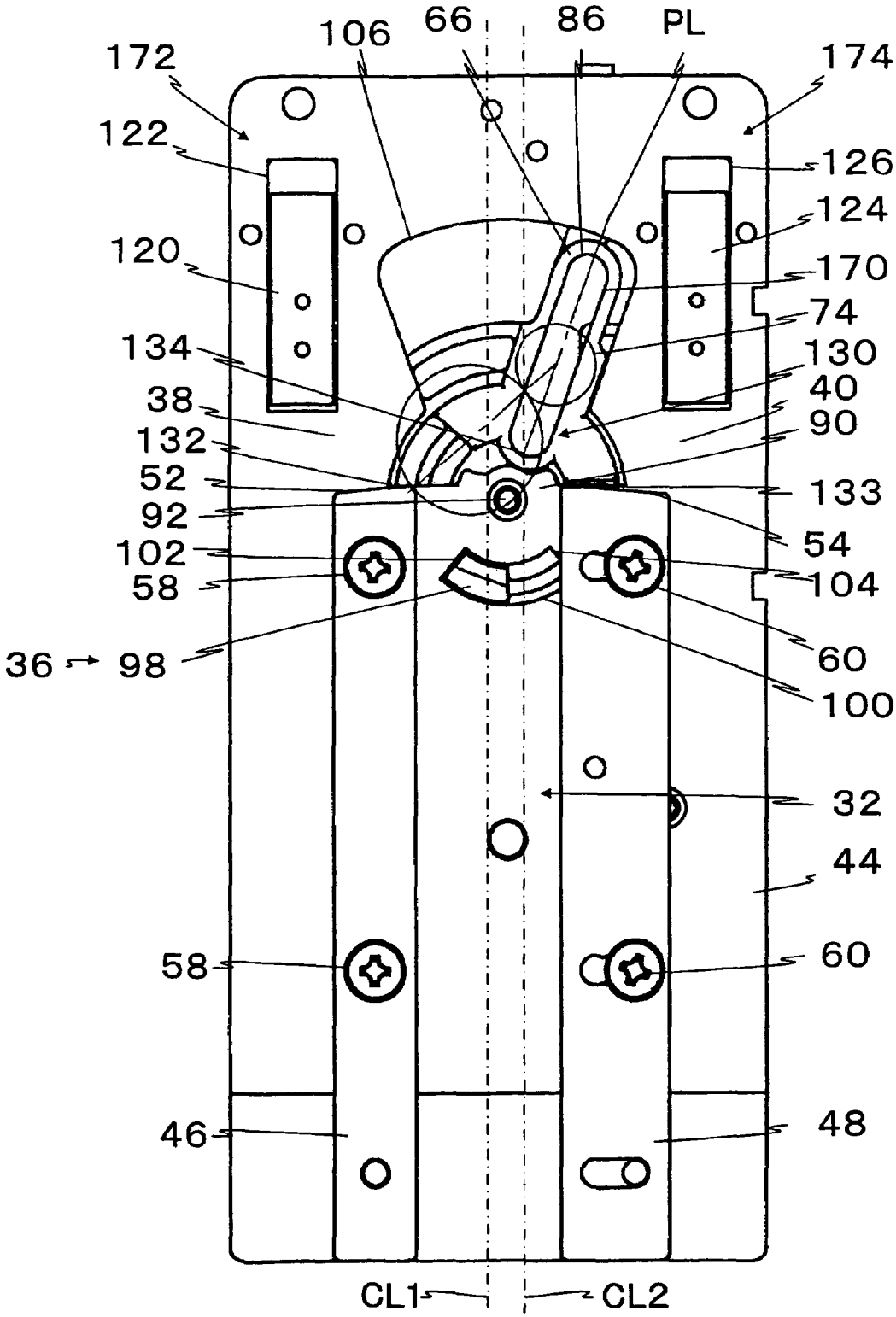
FIG. 7 is a drawing to explain front side action when discs are dispensed to left side in the dispensing apparatus of the present embodiment.

As shown in FIG. 7, the pivot axis 92 is arranged in such manner that it is positioned exactly at the middle point between a central line CL1 of the guiding passageway 32 to a disc D with the smallest diameter and a central line CL2 of the guiding passageway 32 to a disc D with the largest diameter. With such an arrangement, it is possible to minimize a force required for movement of the guiding unit 34 despite the fact that the width of the guiding passageway has been changed to suit the diameter of the disc D.

The base 96 and the lever 66 are made of an integrally molded resin with high abrasion resistance and high shock resistance, e.g. polyacetal resin. A fan-shaped projection 98 with its center on the pivot axis 92 is arranged at a position to match the base plate 44 of the base 96 and opposite to the guide hole 86, and it is inserted into a circular hole 100 of the base plate 44. The circular hole 100 is designed in circular shape with its center on the pivot axis 92.

Each of a left end 102 and a right end 104 of the circular hole 10.0 is a stopper of the fan-shaped projection 98, and prevents overrunning of the projection 98, i.e. the guiding unit 34. The lever 66 is moved within a fan-shaped hole 106, which is formed on the base plate 44 to match an extension of the guiding passageway 32.

Next, a description will be given on the resilient device 36. The resilient device 36 has a function to resiliently move the guiding unit 34 so that it comes closer to the guiding passageway 32. The resilient device 36 comprises a first resilient member 112 and a second resilient member 118. The first resilient member 112 is engaged on a first lock 108 in pin-like shape fixed on the holding plate 56 and on a first locking groove 110 at one end of the pivot axis 72.

The second resilient member 118 is engaged on a second lock 114 in pin-like shape and fixed on the base plate 44 at a position to match the first lock 108 and on a second locking groove 116 on the other end of the pivot axis 72, as shown in FIG. 4. As shown in FIG. 6, the first resilient member 112 and the second resilient member 118 have an identical design and are positioned approximately in parallel to each other. This is to move the roller 74 in parallel as much as possible to ensure smooth discharge of the discs D.

In the present embodiment, a spring is used as the material of the first resilient member 112 and the second resilient member 118, while an alternative rubber material or other equivalent material may be used. That is, resilient member is a general term of a material, which has an elongation and a resilient force approximately proportional to each other. Further, only one resilient member may be used if the guiding unit 34 can be moved in parallel.

Next, a description will be given on the disc detecting device 42. The disc detecting device 42 has a function to sense and detect a disc D, which is discharged from the first outlet 38 and the second outlet 40. A first elongated mounting hole 122 of a first sensor 120 is formed in parallel to an extension of the guiding passageway 32 on an upper portion of the first guide plate 46 of the base plate 44. A second elongated mounting hole 126 of a second sensor 124 is formed in parallel to an extension of the guiding passageway 32 on an upper portion of the second guide plate 48.

The first sensor 120 has a function to sense and detect that the disc D driven by the guiding unit 34 has passed through the first outlet 38. It is preferable to arrange the first sensor 10 in such manner that it can sense and detect a disc D discharged by the guiding unit 34 without being influenced by the disc D positioned at the outlet 90. Specifically, it is preferable to arrange a sensor along a route where the disc D, downstream of the first outlet 38, passes through.

To avoid damage and friction due to collision of the disc D, it is preferable that a non-contact type sensor such as opto-electrical type or a magnetic type is used as the first sensor 120. The first sensor 120 used in the present embodiment is an opto-electrical sensor, in which a light projector (not shown) is arranged in one of the disc passageways and a light receiving unit (photodetection unit) (not shown) is arranged on the other of the disc passageways on a body member 128 of downward-directed gate type as shown in FIG. 1, FIG. 3, and FIG. 6. Output of the first sensor 120 is used to count the discharged discs D.

The second sensor 124 is arranged in the same manner as the first sensor 120, and it senses and detects the discs D discharged from the second outlet 40. As shown in FIG. 2, the guiding unit 34 is positioned in an extended passageway 130 on an extension of the guiding passageway 32, and it can be selectively positioned on one side of the central line CL1 or CL2 of the guiding passageway 32, i.e. on left side, and on right side as shown in FIG. 7.

In other words, the position of the guiding unit 34 can be changed by pivotal movement of the lever 66 using the pivot axis 92 of the lever 66 as fulcrun. This relation is not changed even when the second guide plate 48 is moved and the width of the guiding passageway 32 is changed.

It is designed in such manner that a distance between a first tip of the first guide plate 46 is shorter than the diameter of the disc D when the guiding unit 34 is positioned on left side (the position shown in FIG. 7), and a distance between a second tip of the second guide plate 48 and the guiding unit 34 is shorter than the diameter of the disc D when the guiding unit 34 is positioned at a right side (the position shown in FIG. 2). In other words, the pivot axis 72 is locked on a lower end 134 of the guide hole 86 at the position as described above. By this setting, it is possible to prevent the unlimited discharge of discs D from the outlet 90.

In case the guiding unit 34 is not a roller, it is preferably made of a material with high abrasion resistance such as stainless steel, ceramics, resin with glass beads, etc. Because the guiding unit 34 and the guiding device 68 are moved by an actuator, it is preferable that these are made of a light-weight material such as resin in order to have higher responsiveness.

Next, a description will be given of a moving unit 70 of the dispensing apparatus 30 by referring to FIG. 5 and FIG. 8. On a bracket 136 bent at a right angle toward the rear surface from the base plate 44, an actuator 138 is fixedly mounted. A solenoid 140 is used as the actuator 138 in the present embodiment, while a fluid actuator, an electric motor, etc, may be used. However, the use of the solenoid 140 contributes to cost reduction.

Figure 5:
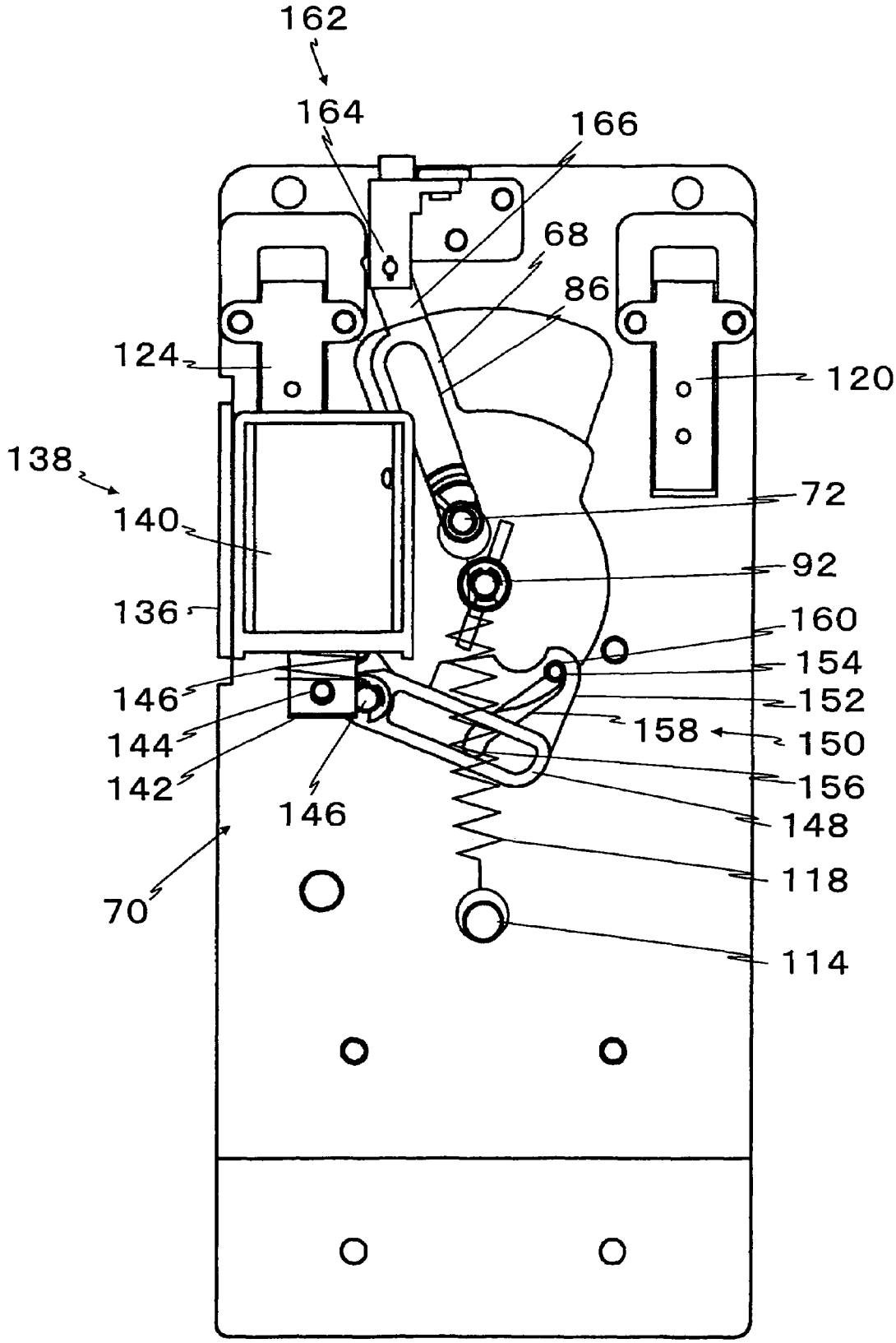
FIG. 5 is a rear view of the dispensing apparatus of the present embodiment.

A pin 144 is mounted on a plunger 142 of the solenoid 140 and a compression spring 146 is arranged between the pin 144 and the solenoid 140, and the plunger 142 is resiliently pushed in a protruding direction (downward direction in FIG. 5). The pin 144, fixed at the tip of the plunger 142, is pivotally supported on one end of the lever 148, which is pivotally supported on a shaft 146 fixed on the base plate 44.

On the other end of the lever 148, a cam plate 152 with a cam groove 150 is fixed. The cam groove 150 is designed in a crank-like shape, and its upper end serves as a right holding groove 154 and its lower end serves as a left holding groove 156. A moving groove 158 is provided between these two holding grooves. A pin 160 fixed on rear surface of the base 96 is movably inserted into the cam groove 150.

Figure 8:
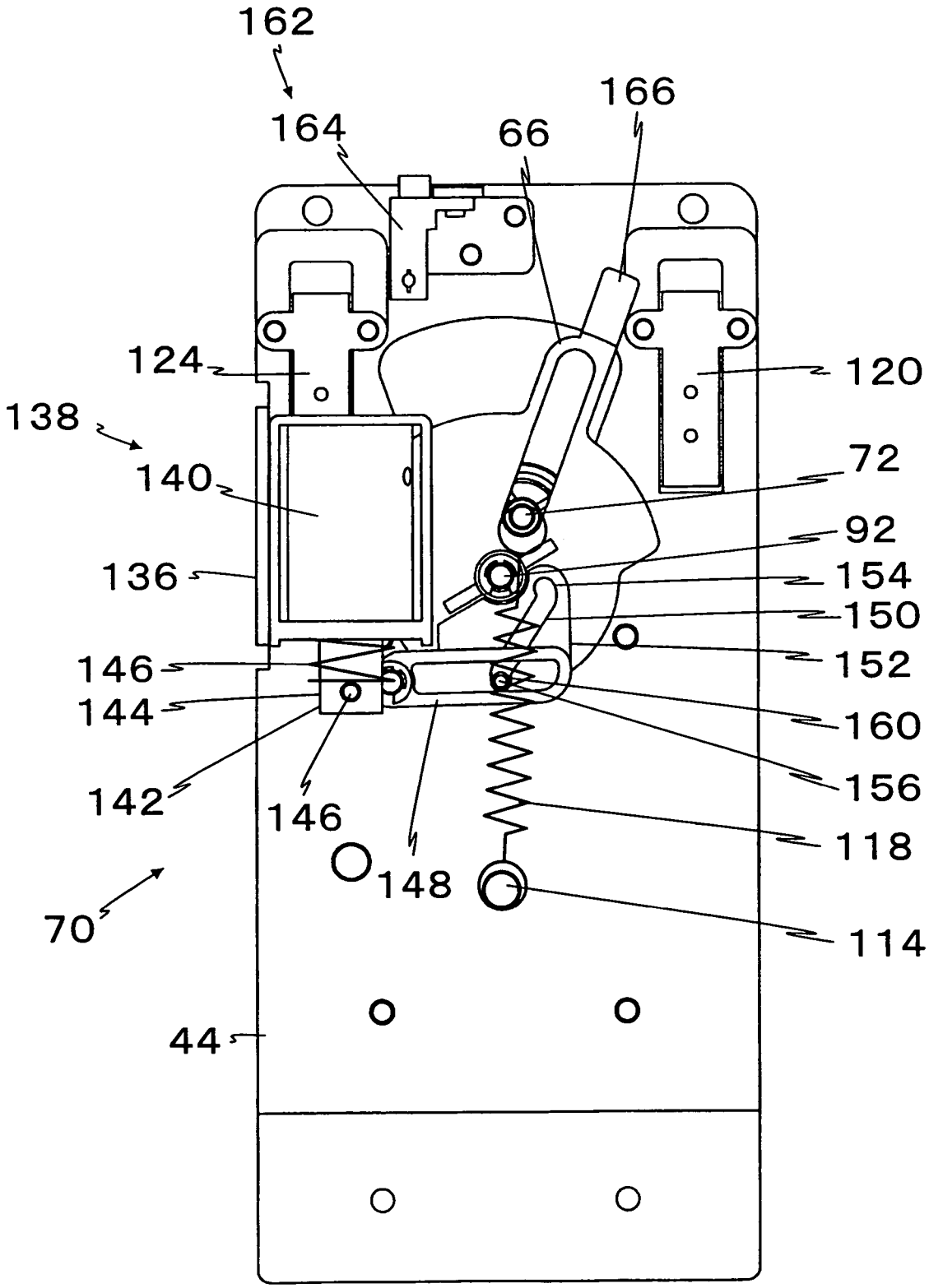
FIG. 8 is a drawing to explain rear side action when discs are dispensed to right side in the dispensing apparatus of the present embodiment.

As shown in FIG. 8, when the solenoid 140 is demagnetized, the lever 148 is rotated counterclockwise, and the pin 160 is positioned in the left holding groove 156. Specifically, it is a condition where the pin 144 is pushed down by the spring 146 and the lever 148 is pivotally moved so that it is approximately at a horizontal position as shown in FIG. 5. By this movement, the lever 66 is pivotally moved clockwise, and the guiding unit 34 moves to a left side position as shown in FIG. 2 When the guiding unit 34 is at the position shown in FIG. 2, the disc D is discharged from the second outlet 40.

When the solenoid 140 is magnetized, the plunger 142 is lifted up. As a result, the lever 148 is pivotally moved clockwise as shown in FIG. 5. When the lever 148 is tilted in a left downward direction, the pin 160 is positioned in the right holding groove 154. As a result, the guiding unit 34 is positioned on the right side of the central lines CL1 and CL2 as shown in FIG. 7. Therefore, the position of the guiding unit 34 is selectively determined by the pin 160, which is positioned in the right holding groove 154 or in the left holding groove 156.

In this respect, a stopper comprising the circular hole 100 and the projection 98 may not be provided if necessary. Also, the base 96 may be fixed on the pivot axis 92, and the pivot axis 92 may be rotated by a rotary solenoid or the like.

Next, a position sensor 162 will be described. The position sensor 162 has a function to detect whether the guiding device 68 is positioned on the left side or on the right side of the central lines CL1 and CL2. The position sensor 162 comprises a transmission type opto-electrical sensor 164 fixed on an upper end of the base plate 44 and an operating piece 166 extended from an upper end of the lever 66.

When the guiding unit 34 is positioned on the left side of the central lines CL1 and CL2, the operating piece 166 intercepts optical axis of the opto-electrical sensor 164 as shown in FIG. 5, and a detection signal is issued. Based on the detection signal, the position of the guiding unit 34 is determined. When the guiding unit 34 is positioned on the right side of the central lines CL1 and CL2 as shown in FIG. 8, the opto-electrical sensor 164 does not detect the operating piece 166, and the detection signal is not issued. As a result, the position of the guiding unit 34 is judged.

The moving unit 70 has a function to selectively set the position of the guiding unit 34 to the right side or the left side of the central lines CL1 and CL2. Therefore, the moving unit is not limited by the embodiment. For instance, the guiding unit 34 can be positioned on the left side of the central lines CL1 and CL2 when the solenoid 140 is demagnetized.

When the pivot axis 72 is stopped at a lower end 134 of the guide hole 86, the contact portion 80 is kept at such position that a distance from a first tip 132 of the first guide plate 46 and a distance from a second tip 133 of the second guide plate 48 are shorter than the diameter of the disc D. However, when it is pushed by the disc D, the distance from the first tip 132 of the first guide plate 46 or the distance from the second tip 133 of the second guide plate 48 is moved at least in an amount equal to the diameter of the disc D, and the disc D can pass through and between these points.

As the stopper of the pivot axis 72, a special-purpose stopper may be used, which is mounted on the base 96 instead of the base 134 so that the position can be adjusted. When the guiding unit 34 is a roller 74, frictional resistance to the disc D is low, and this provides an effect to promote smooth discharge of the disc D.

A reflection type opto-electrical sensor may be used as the disc detecting device 42. Also, a sensor other than opto-electrical sensor may be used as the disc detecting device 42. Further, it may be designed in such manner that the movement of the pivot axis 72 or the guiding unit 34 can be detected. In this case, only one sensor may be used for the disc detecting device 42.

Next, a description will be given on the operation of the present embodiment.

First, by referring to FIG. 2 and FIG. 8, a description will be given on the operation in the case the guiding unit 34 positioned on the left side of the central lines CL1 and CL2 as shown in FIG. 2. Specifically, the solenoid 140 is demagnetized and the plunger 142 is pushed down by the spring 146. The lever 148 is rotated counterclockwise in FIG. 8. As a result, the pin 160 is positioned in the left holding groove 156, As a result, the guiding device 68 is rotated counterclockwise as shown in FIG. 2, and the guiding unit 34 is positioned on the left side of the central lines CL1 and CL2.

Under this condition, the rotary disc (not shown) is rotated, and the disc D in the holding bowl 14 is moved one by one to the escalator guiding passageway 26. The discs D are aligned in a row with peripheral surfaces kept into contact with each other in the escalator guiding passageway 26. The disc D is sequentially pushed upward by a disc D newly delivered from the rotary disc and reaches the guiding passageway 32.

The foremost disc D protrudes from the outlet 90 of the guiding passageway 32 and comes into contact with the contact portion 80 of the roller 74. Because the position of the roller 74 is deviated to the left side from the central lines CL1 and CL2, the left peripheral surface of a diameter portion of the disc D comes into contact with the roller 74. Then, the disc D is pushed up further. As a result, the disc D is moved to separate away from the guiding passageway 32 against the resilient force of the first resilient member 112 and the second resilient member 118.

Figure 9:
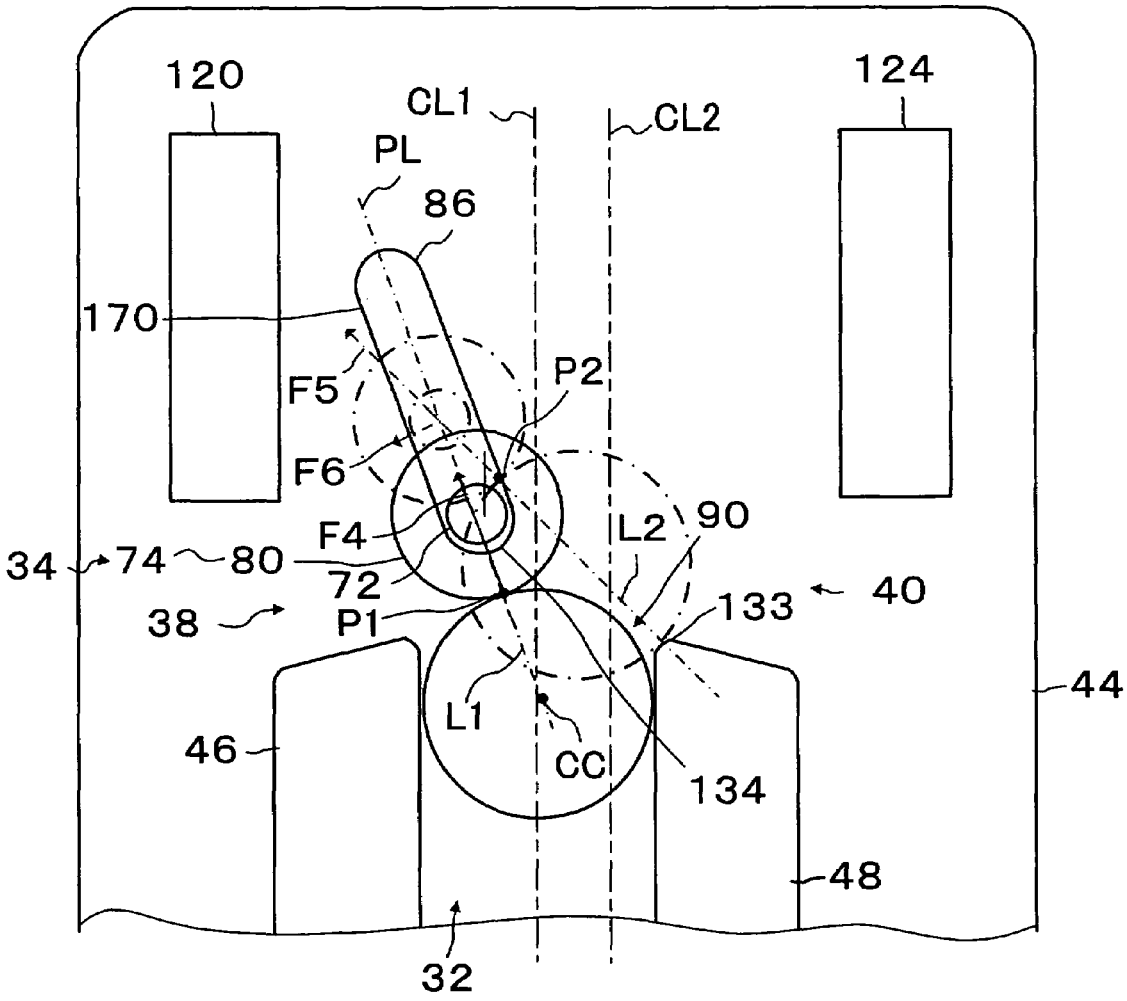
FIG. 9 is a schematical drawing to explain operation of the embodiment.

Specifically, as the pivot axis 72 (bearing 76) is guided to the guide hole 86 and it is separated away from the guiding passageway 32, it is moved in a linear direction to separate from the central lines CL1 and CL2. When the disc D is brought into contact with the contact portion 80, it is pushed by a force F4 from a contact point P1 of the disc D as shown in FIG. 9. Because the direction of the force F4 is approximately aligned with a straight line L1, which passes through the center CC of the disc D and the contact point P1, this is approximately aligned with elongating direction of the guide hole 86.

Therefore, a component force of the bearing 76 to push against the side wall of the guide hole 86 does not or is very slight.

By resilient force of the first resilient member 112 and the second resilient member 118, the bearing 76 receives the component force applied to the outer edge of the guide hole 86. However, the component force is very weak because the forces of the first resilient member 112 and the second resilient member 118 form a very small angle with the central lines CL1 and CL2. In other words, when the pivot axis 72 moves within the guide hole 86, its resistance to movement is very low. The roller 74 comes into contact at a position on the right side (in FIG. 2) from the center CC of the disc D. As a result, the disc D is sandwiched between the second tip 133 of the second guide plate 48 and the roller 74, and it is guided in a rightward direction.

As shown by one-dot chain line in FIG. 9, a force F5 is exerted on the guiding unit 34 via the contact point P2 immediately before the disc D is driven by the guiding unit 34. This force F5 is positioned on a straight line L2, which passes through the second tip 133 of the second guide plate 48 and the center CC of the disc D, and it is tilted with respect to the axial line PL of the guide hole 86. Therefore, a component force F6 of this force F5 and component forces of resilient forces of the first resilient member 112 and the second resilient member 118 are applied on the side wall 170. That is, as the guiding unit 34 moves away from the guiding passageway 36, the component force applied on the outer edge 170 is increased.

In the conventional type apparatus, a component force is applied on the side wall from an early stage when the disc D comes into contact with the guiding unit 34. Thus, the guiding unit 34 does not move very smoothly. In the present embodiment, however, the component force is not applied or is very slight when the disc D is first brought into contact with the guiding unit 34. Therefore, the guiding unit 34 moves smoothly. Also, the guiding unit 34 moves in a traverse direction and in an extending direction in FIG. 2 with respect to the disc D. In particular, the displacement in a traverse direction is high because the guide hole 86 is tilted with respect to the central lines CL1 and CL2. Therefore, the amount of extension of the first resilient member 112 and the second resilient member 118 is lower than in the conventional type apparatus.

In other words, the displacement of the roller 74 is low in the present embodiment, This makes it possible to reduce the resilient force of the first resilient member 112 and the second resilient member 118. Therefore, the resultant impact force when the bearing 76 is stopped at the end 134 is low. This makes it possible to prevent the "fatigue" of the end 134, which serves as a stopper. Also, the bearing 76 is made of resin in the present embodiment. Thus, it is lower in hardness compared with the base 44, which is generally made of metal material, and it has a function of a resilient member.

Therefore, this resilient function alleviates the impact as described above, and this also prevents the "fatigue" of the stopper. Because the resilient force is low, the disc D is driven by the guiding unit 34 at a relatively low speed. This leads to the extension of the range of time when the disc D is sensed and is detected by the second sensor 124, and this is helpful to eliminate any error in the detection of the disc D.

When the center CC of the disc D in FIG. 9 goes beyond a line L2, which connects the first tip 132 with the contact point P2, the disc is driven out through the second outlet 40 on the right side by resilient force of the first resilient member 112 and the second resilient member 118. The disc D thus driven is discharged to the apparatus as required via a predetermined route. During this process, the disc D intercepts the optical axis from the projector of the second sensor 124 to the photodetection unit. As a result, the second sensor 124 issues a coin detection signal.

Because the function of the guiding unit 34 is separated from the function of the second sensor 124, the passing of the disc D can be sensed and detected by the second sensor 124 even in a case where the guiding unit 34 collides with the disc D when the movement of the guiding unit 34 is restored by the first resilient member 112 and the second resilient member 118. Therefore, there is no need to adjust the length of the route of the disc D from the rotary disc to the guiding unit 34. The second sensor 124 senses and detects the disc D immediately after it is discharged through the second outlet 40, and a detection signal is issued. The detection signal is used to count the discs D and to discriminate any poor detection of the discharge.

Next, description will be given on a case where the guiding unit 34 is positioned at the right side of the center lines CL1 and CL2 as shown in FIG. 7 by referring to FIG. 5 and FIG. 7. Because a peripheral surface on the left side of the disc D first comes into contact with the roller 74 earlier than opposite diameter portion, a force similar to the force as described above is applied, and the disc D is moved toward the first outlet 38.

As a result, the disc D is pushed and moves the roller 74 upward while it is kept in contact with the first tip 132. When the diameter portion of the disc D passes between the first tip 132 and the roller 74, the disc D is vigorously discharged through the first outlet 38 by the resilient force of the resilient device 36. Immediately after being discharged, the disc D is detected by the first sensor 120.

Next, a description will be given on a case where the roller 74 is moved from the position shown in FIG. 2 to the position on the right side shown in FIG. 7 under the condition that the roller 74 is kept in contact with peripheral surface of the disc D protruding from the outlet 90. Specifically, when the solenoid 140 is magnetized, the lever 148 is pivotally moved clockwise from the position shown in FIG. 8 to the position shown in FIG. 5. As a result, the pin 160 is moved from the second holding groove 156 to the first holding groove 160, and the lever 66 is pivotally moved clockwise from the position shown in FIG. 2 to the position shown in FIG. 7.

By this pivotal movement, the guiding unit 34 is moved clockwise via the pivot axis 72 while keeping contact with peripheral edge of the disc D. In this case, the roller 74 comes into rolling contact with the disc D, and the radius of curvature of a peripheral edge of the disc D is approximately equal to a radius of curvature of pivotal movement of the roller 74 around the pivot axis 92. Therefore, when the roller 74 climbs over the disc D, the force to move the roller 74 may be low because the ascending gradient is low. As a result, the guiding unit 34 can be moved by an actuator 138 with small output.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A disc dispensing apparatus, comprising:

a guiding passageway for guiding discs aligned in one row;

a guide hole member with an elongated guide hole, the guide hole member is pivotally movable around an axis with an axial line almost perpendicularly crossing the guiding passageway near an outlet of the guiding passageway on an extension of said guiding passageway, the guide hole member operatively positions the elongated guide hole at a position angularly offset from a center line of the guiding passageway;

a guiding unit guided within the elongated guide hole member and resiliently pushed toward the guiding passageway; and a moving unit for selectively moving said guide hole member in a pivotal movement to angularly offset the guide hole member from the center line of the guiding passageway.

2. The disc dispensing apparatus according to claim 1, wherein said axis is positioned approximately at a middle point between a largest width and a smallest width of said guiding passageway.

3. The disc dispensing apparatus according to claim 1 wherein the moving unit includes a solenoid member.

4. The disc dispensing apparatus according to claim 1 wherein the guiding unit includes a elongated cylinder member with a pair of springs, one at each end of the cylinder.

5. The disc dispensing apparatus according to claim 1 wherein the guide hole has an elongated oblong shape.

6. The disc dispensing apparatus according to claim 1 further including a first disc sensor positioned on a first side of the guiding passageway and a second disc sensor positioned on a second side of the guiding passageway.

7. The disc dispensing apparatus according to claim 1 wherein the guiding unit includes a bearing member and roller rotatably mounted about the bearing member.

8. The disc dispensing apparatus according to claim 7 wherein a first spring is mounted at one end of the bearing member and a second spring is mounted at the other end of the bearing member to bias the guiding unit.

9. In a disc storing apparatus that dispenses stored discs from a disc passageway, the improvement of a disc dispensing apparatus operatively mounted to the disc passageway comprising;

a moveable guide hole member having a guide hole of an elongated shape movably attached adjacent an outlet of the disc passageway;

a guiding unit operatively mounted in the guide hole;

a resilient unit for biasing the guiding unit against the movement of the discs; and a moving unit operatively attached to the moveable guide hole member for positioning the elongated guide hole at an angle to an axis of the disc passageway on a side of the disc passageway whereby a disc to be dispensed contacts the guiding unit and displaces the guiding unit along the elongated hole while receiving a counter force from the resilient unit to force the disc to be directed away from the guiding unit to one side of the disc passageway.

10. The disc storing apparatus according to claim 9 wherein the guiding unit includes a bearing of a cylindrical shape and a roller rotatably mounted on the bearing, the resilient unit is operatively mounted to the bearing.

11. The disc storing apparatus according to claim 10 wherein the moving unit includes a solenoid.

12. The disc storing apparatus according to claim 11 further including a first disc sensor mounted to count discs dispensed from a first side of the disc passageway and a second disc sensor mounted to count discs dispensed from a second side of the disc passageway.

13. A disc dispensing apparatus, comprising:

a guiding passageway for guiding discs aligned in one row;

a guide hole member with a guide hole pivotally movable around an axis with an axial line almost perpendicularly crossing the guiding passageway near an outlet of the guiding passageway on an extension of said guiding passageway, a pivot axis of the guide hole member is arranged between a central line of the guiding passageway for a smallest diameter disc and a central line of the guiding passageway for a largest diameter disc;

a guiding unit guided within the guide hole member and resiliently pushed toward the guiding passageway; and a moving unit for selectively moving said guide hole member in a pivotal movement.

14. A disc dispensing system, comprising:

a stationary guiding passageway unit for guiding discs to a disc discharge position from a source of discs, wherein a passageway in the guiding passageway unit aligns discs to move by a force contact between discs, from the source to the disc discharge position;

a movable guide device movably attached to the stationary guiding passageway unit adjacent to the disc discharge position having a single extended guide hole and a guiding unit movably mounted in the extended guide hole;

means for biasing the guiding unit towards one end of the extended guide hole adjacent the disc discharge position whereby a discharging disc must force the guiding unit away from the disc discharge position along the extended guide hole before the disc can be discharged; and means for selectively rotating the movable guide device to enable a discharge of a disc from one of opposite sides of a center line of the passageway of the stationary guiding passageway.

15. The disc dispensing system of claim 14 wherein the means for selectively rotating the movable guide device includes a solenoid with a plunger connect to a cam plate having a crank-like shape cam groove, and a pin extends from the movable guide device to be journaled in the cam groove.

16. The disc dispensing system of claim 14 wherein the movable guide device has an enlarged base with a lever portion protruding from the enlarged base, the extended guide hole resides in both the enlarged base and the lever portion.

17. The disc dispensing system of claim 16 further including a position sensor to monitor the position of the lever portion.

18. The disc dispensing system of claim 17 wherein the guiding unit is a roller mounted for rotation on a pivot axis member and the means for biasing the guiding unit includes a pair of spring members connected to the pivot axis member.

19. The disc dispensing system of claim 18 where the movable guide device pivots about a pivot axis arranged between a central line of the guiding passageway unit for a smallest diameter disc and a central line of the guiding passageway unit for a largest diameter disc.

* * * * *